US008680756B2

(12) United States Patent
Rong et al.

(10) Patent No.: US 8,680,756 B2
(45) Date of Patent: Mar. 25, 2014

(54) OPTICAL SYSTEM FOR A LUMINAIRE

(75) Inventors: Wei Rong, Peachtree City, GA (US); Reed Bradford, Peachtree City, GA (US); Barton Kirk Ideker, Fayetteville, GA (US); Grzegorz Wronski, Peachtree City, GA (US); Adam M. Foy, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 1008 days.

(21) Appl. No.: 12/624,127

(22) Filed: Nov. 23, 2009

(65) Prior Publication Data

US 2011/0121709 A1 May 26, 2011

(51) Int. Cl.

| | |
|---|---|
| ***H01J 5/16*** | (2006.01) |
| ***H01J 1/02*** | (2006.01) |
| ***H01J 61/30*** | (2006.01) |

(52) U.S. Cl.

USPC ..... 313/113; 313/623; 313/46

(58) Field of Classification Search

USPC ..... 313/113, 623, 634, 46

See application file for complete search history.

(56) References Cited

U.S. PATENT DOCUMENTS

| | | | | |
|---|---|---|---|---|
| 3,737,653 | A * | 6/1973 | Biggs et al. | 362/308 |
| 6,494,596 | B1 * | 12/2002 | Burroughs | 362/348 |

* cited by examiner

*Primary Examiner* — Joseph L Williams

(74) *Attorney, Agent, or Firm* — King & Spalding LLP

(57) ABSTRACT

A HID luminaire includes a HID lamp, a reflector, and a lens. The reflector has a proximal end, a distal area, and an intermediate are positioned therebetween. The reflector has an interior surface that includes a first portion that extends from the proximal end to the intermediate area and a second portion that extends from the intermediate area to the distal end. The second portion is less light reflective than the first portion. The lens has two different diffusion rates and includes a center portion having a lens inner diameter and an outer portion surrounding the center portion. The lens inner diameter is about the same diameter as the diameter of the intermediate area. The outer portion is more diffuse than the center portion but allows light to be transmitted therethrough.

33 Claims, 6 Drawing Sheets

OPTICAL SYSTEM FOR A LUMINAIRE

TECHNICAL FIELD

The present invention relates generally to high intensity discharge ("HID") luminaries, and more particularly, to an optical system of a HID luminaire that eliminates the gravity effect and wire shadow typically associated therewith.

BACKGROUND

FIG. 1 is an elevation view of a conventional single ended HID lamp 100 in accordance with the prior art. The HID lamp includes an arc tube 140 having at least two electrodes 120 and 130, a support wire 150, and a protective envelope 110 for housing the arc tube 140 and the support wire 150.

Examples of the HID lamp 100 include mercury vapor lamps, metal halide lamps, high and low pressure sodium vapor lamps, xenon short-arc lamps, and ultra-high performance mercury arc lamps. The HID lamp 100 produces light by generating an electric arc across two spaced-apart electrodes 120 and 130 housed inside the arc tube 140. The arc tube 140 can be a translucent or a transparent fused quartz or fused alumina arc tube. The electrodes 120 and 130 are typically fabricated using tungsten, but other materials can be used.

The arc tube 140 is suspended within an outer protective envelope 110 using the support wire 150. The support wire 150 is fabricated using an electrically conductive material that carries electricity to and from the arc tube 140. The support wire 150 also provides support for the arc tube 140 to be suspended within the outer protective envelope 110. The outer protective envelop 110 is fabricated using a transparent or translucent material that allows the light generated within the arc tube 140 to be emitted to a desired area for illumination.

The arc tube 140 also includes an arc tube cavity 141 having a top surface 144 and a bottom surface 146. The top surface 144 is the highest elevated portion of the arc tube cavity 141, while the bottom surface 146 is the lowest elevated portion of the arc tube cavity 141. The arc tube cavity 141 can be vertically oriented, horizontally oriented, or oriented at any angle therebetween. In FIG. 1, the arc tube cavity 141 is oriented vertically. Hence, the top surface 144 is located at the boundary between the electrode 120 and the arc tube cavity 141, and the bottom surface 146 is located at the boundary between the electrode 130 and the arc tube cavity 141. The arc tube cavity 141 has an arc tube diameter 142, which is the maximum width of the arc tube cavity 141.

The arc tube cavity 141 is typically filled with gas or a mixture of gas and metals. For example, the arc tube cavity 141 may be filled under pressure with pure xenon, a mixture of xenon-mercury, sodium-neon-argon, sodium-mercury-neon-argon, or some other mixture such as argon, mercury, and one or more metal halide salts. A metal halide salt is a compound of a metal and a halide, such as bromine, chlorine, or iodine. Some of the metals that have been used in metal halide lamps include scandium, sodium, thallium, and indium. Typically, xenon, neon, or argon gas is used in HID lamps because they are easily ionized and provide some level of light. These gases facilitate the striking of an arc between the two electrodes 120 and 130 when voltage is first applied to the HID lamp 100. Once the arc is started, the arc heats up and evaporates the metal salts thereby forming a plasma, which greatly increases the intensity of the light produced by the arc and reduces the power consumption.

The HID lamp 100 typically requires a ballast (not shown) to regulate the arc current flow and to deliver the proper voltage to the arc. Some HID lamps include a third electrode (not shown) within the arc tube that initiates the arc when the HID lamp is first lit. Alternatively, other HID lamps 100, such as the one shown in FIG. 1, use an igniter (not shown), or starting circuit, in lieu of the third electrode, to generate a high-voltage pulse to the electrodes 120 and 130 to start the arc. The formation of the arc requires a high current; but, once the arc is at steady-state conditions, much less current is required to operate the HID lamp 100. Compared with fluorescent and incandescent lamps, HID lamps 100 provide higher luminous efficacy since a greater portion of their radiation is in visible light as opposed to heat.

FIG. 2 is an illustration of a gravity effect 210 and a wire shadow 220 in an area 200 illuminated by the HID lamp 100 of FIG. 1 in accordance with the prior art. Typically, metal halide HID lamps exhibit the gravity effect 210 and the wire shadow 220; however, the gravity effect 210 and the wire shadow 220 can occur in other types of HID lamps. The gravity effect 210, or a yellow image, is an inherent color shift that settles in a particular spot in the arc tube 140. This color shift is based upon all of the components within the arc tube 140 and tends to slightly change the color and the intensity of the light that is emitted from the arc tube 140. According to typical HID luminaries (not shown), the optical system (not shown), which includes one or more reflectors and lenses, reflects the light emitted by the arc tube 140 to the area 200 that is illuminated, such as, a wall or a floor. The wire shadow 220 is a shadow of the support wire 150 that is formed in the area 200 that is illuminated. As previously mentioned, the support wire 150 is a wire or other mechanical means for suspending the arc tube 140 within the outer protective envelope 110 of the HID lamp 100. Although FIG. 2 illustrates the gravity effect 210 and the wire shadow 220 occurring substantially in the same location of the area 200 that is illuminated, the gravity effect 210 and the wire shadow 220 can occur in different locations.

In the past, some manufactures have attempted to minimize the wire shadow 220 by fabricating the support wire 220 using thinner and smaller wire sizes. Alternatively, manufactures have attempted to address both the gravity effect 210 and the wire shadow 220 by completely blocking the light emitting portion that includes the gravity effect 210 and the wire shadow 220 or by spreading out the entire light emission so that the gravity effect 210 and the wire shadow 220 are mixed with the rest of the emitted light. These solutions typically use a material having a highly diffusive finish on either or both of the reflector and the lens. The conventional lens is typically fabricated with prismatic elements formed across the entire surface of the lens. Alternatively or additionally, the reflector is typically fabricated as a pillow style reflector, which has numerous tiny bumps that are formed onto the entire reflector's inner surface. The use of a highly diffuse type of lens or a diffuse finish on the reflector's inner surface allows the light to be mixed and spreads the emitted light so that the gravity effect 210 and the wire shadow 220 is reduced or eliminated. However, the efficiency of the emitted light is substantially decreased when using these conventional solutions, because some of the generated light is reflected multiple times before being transmitted through the lens, while other portions of the generated light are never transmitted through the lens. Each time a ray of light bounces (or reflects) off the reflector's inner surface, the light emitting efficiency is reduced due to a loss of energy. In most conventional fixtures, approximately ten percent of the light's energy is absorbed each time the beam of light bounces off the reflector's inner surface. Thus, if the light bounces twice off the reflector's inner surface before being transmitted through the lens, the light efficiency is eighty-one percent, or (0.9)*(0.9)*(100%).

In view of the foregoing, there is a need in the art for providing a HID luminaire that reduces or eliminates the wire shadow and/or the gravity effect while improving lighting efficiency.

SUMMARY

According to one exemplary embodiment, a HID luminaire can include a HID lamp and a reflector. The reflector can have a proximal end, a distal end and an internal surface extending from the proximal end to the distal end. The HID lamp can be disposed within the reflector near the proximal end. The internal surface of the reflector can include a first portion, an intermediate area, and a second portion. The first portion can extend from the proximal end to the intermediate area and the second portion can extend from the intermediate area to the distal end. The second portion can be less light reflective than the first portion.

According to another exemplary embodiment, a HID luminaire can include a HID lamp, a reflector, and a lens. The reflector can have a proximal end, a distal end and an internal surface extending from the proximal end to the distal end. The HID lamp can be disposed within the reflector near the proximal end. The lens can be coupled to the distal end of the reflector. The lens can have a center portion and an outer portion that surrounds the center portion. The center portion can be substantially clear and the outer portion can be substantially more diffuse than the center portion. The outer portion produces outgoing light rays having a beam spread angle of greater than 2.5 degrees when an incoming light ray enters the outer portion at a perpendicular angle.

According to another exemplary embodiment, a HID luminaire can include a HID lamp, a reflector, and a lens. The lamp can include an arc tube that can have an arc tube cavity positioned between two electrodes. The arc tube cavity can have a top surface and a bottom surface. The reflector can have a proximal end, a distal end and an internal surface extending from the proximal end to the distal end. The internal surface of the reflector can include a first portion, an intermediate area, and a second portion. The first portion can extend from the proximal end to the intermediate area and the second portion can extend from the intermediate area to the distal end. The second portion can be less light reflective than the first portion. The lens can be positioned near the distal end of the reflector. The lens can have a center portion and an outer portion that surrounds the center portion. The center portion can be substantially clear and the outer portion can be substantially more diffuse than the center portion. The inner diameter of the center portion can range from about 87.5 percent to about 112.5 percent of the diameter of the intermediate area. The intermediate area can be positioned at an elevational level that ranges from the bottom of the arc tube to the top of the arc tube.

According to another exemplary embodiment, a HID luminaire can include a HID lamp, a reflector, and a lens. The reflector can have a proximal end, a distal end and an internal surface extending from the proximal end to the distal end. The lens can be positioned adjacent the reflector. The lens can have a first portion and a second portion that surrounds the first portion. Each of the first portion and the second portion of the lens can have different diffusion rates.

According to another exemplary embodiment, a HID luminaire can include a HID lamp, a reflector, and a substantially circular lens. The reflector can have a proximal end, a distal end and an internal surface extending from the proximal end to the distal end. The lens can be disposed adjacent the reflector. The lens can have a first portion and a second portion that can be disposed around the first portion. The first portion can be substantially clear portion and the second portion can have at least one frosted surface.

BRIEF DESCRIPTION OF THE DRAWINGS

The foregoing and other features and aspects of the invention may be best understood with reference to the following description of certain exemplary embodiments, when read in conjunction with the accompanying drawings, wherein.

Figure 1:
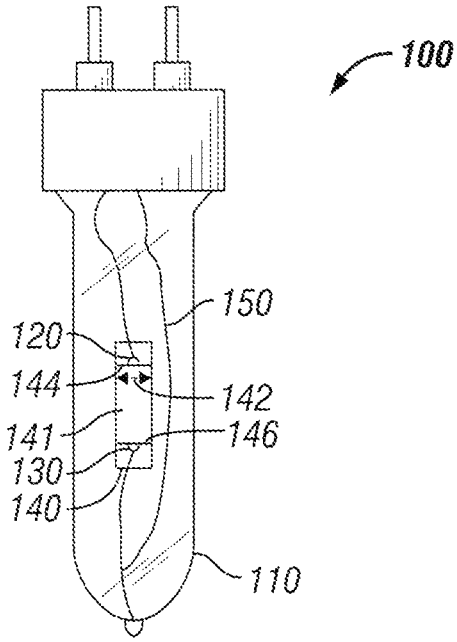
FIG. 1 (Prior Art)
FIG. 1 is an elevation view of a single ended HID lamp in accordance with the prior art.
Figure 2:
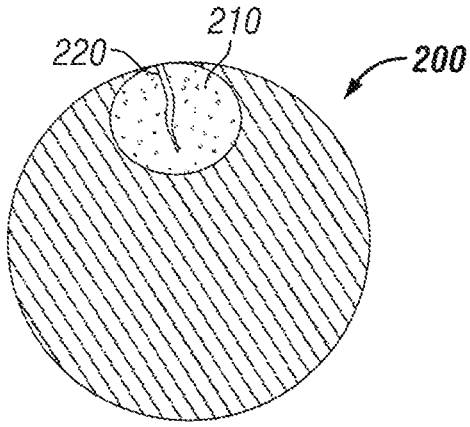
FIG. 2 (Prior Art)
FIG. 2 is an illustration of a gravity effect and a wire shadow in an area illuminated by the HID lamp of FIG. 1 in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to high intensity discharge ("HID") luminaries. Although the description of exemplary embodiments is provided below in conjunction with a particular type of HID lamp, alternate embodiments of the invention may be applicable to other types and configurations of HID lamps.

The invention is better understood by reading the following description of non-limiting, exemplary embodiments with reference to the attached drawings, wherein like parts of each of the figures are identified by like reference characters, and which are briefly described as follows.

Figure 3:
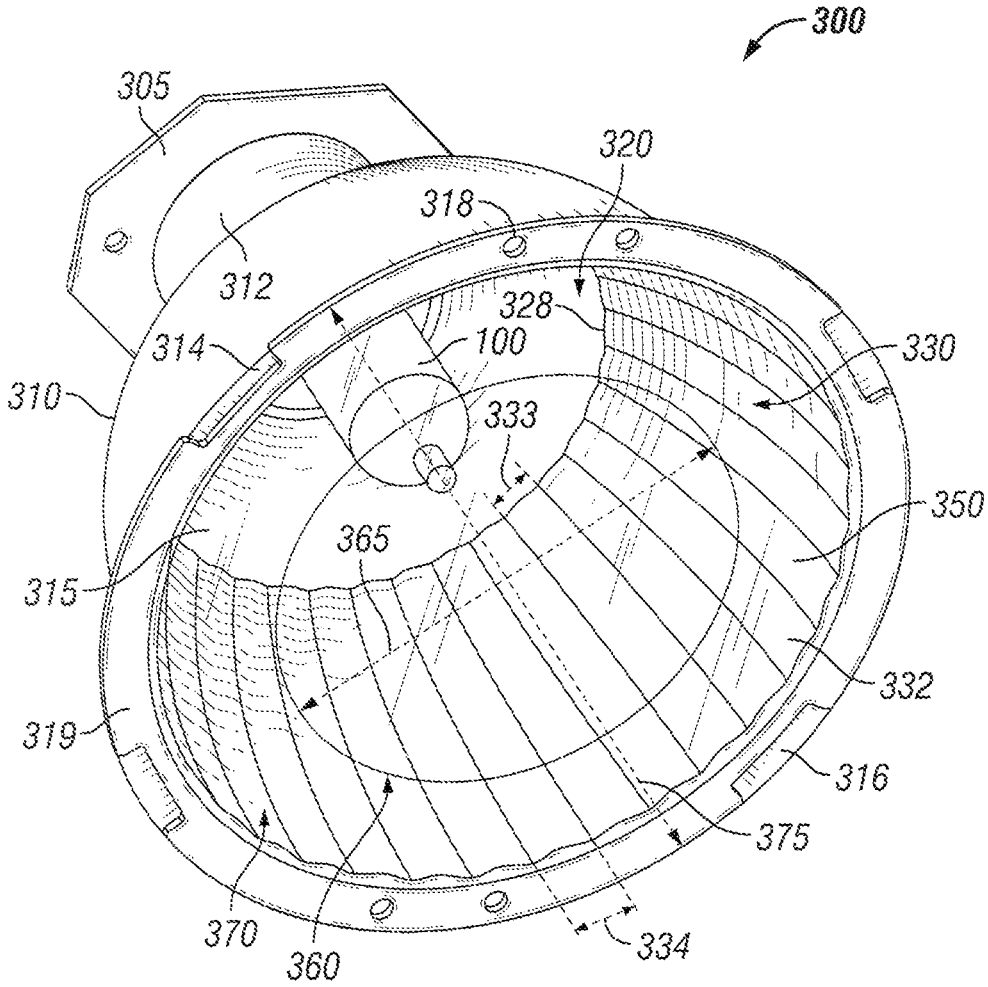
FIG. 3 is a perspective view of a HID luminaire in accordance with an exemplary embodiment of the present invention.

FIG. 3 is a perspective view of a HID luminaire 300 in accordance with an exemplary embodiment of the present invention. Now referring to FIG. 3, the HID luminaire 300 includes the HID lamp 100, the reflector 310, and the lens 350.

The HID lamp 100 represents any type of HID lamp including, but not limited to, mercury vapor lamps, metal halide lamps, high and low pressure sodium vapor lamps, xenon short-arc lamps, and ultra-high performance mercury arc lamps. Although one exemplary type of HID lamp 100 has been described with reference to FIG. 1, other types and configurations of HID lamps can be used within the HID luminaire 300 without departing from the scope and spirit of the exemplary embodiment.

In one exemplary embodiment, the reflector 310 is parabolic-shaped and has a proximal end 312 and a distal end 314. As shown in this exemplary embodiment, the proximal end 312 is coupled to a mounting member 305 that is used to mount the HID luminaire 300 within a housing (not shown) that is coupled to a ceiling, wall, or other type of suitable structure. In one exemplary embodiment, the distal end 314 forms a flange 319 that bends outwardly from the reflector 310. In certain exemplary embodiments, the creation of a flange 319 is done to facilitate the coupling of the lens 350 to the distal end 314 of the reflector 310. The parabolic-shaped reflector 310 focuses the light emitted by the lamp 100 to create a beam of light. Although this exemplary embodiment depicts a parabolic-shaped reflector 310, other geometric shaped reflectors known to those of ordinary skill in the art are within the scope and spirit of the exemplary embodiment.

Figure 9:
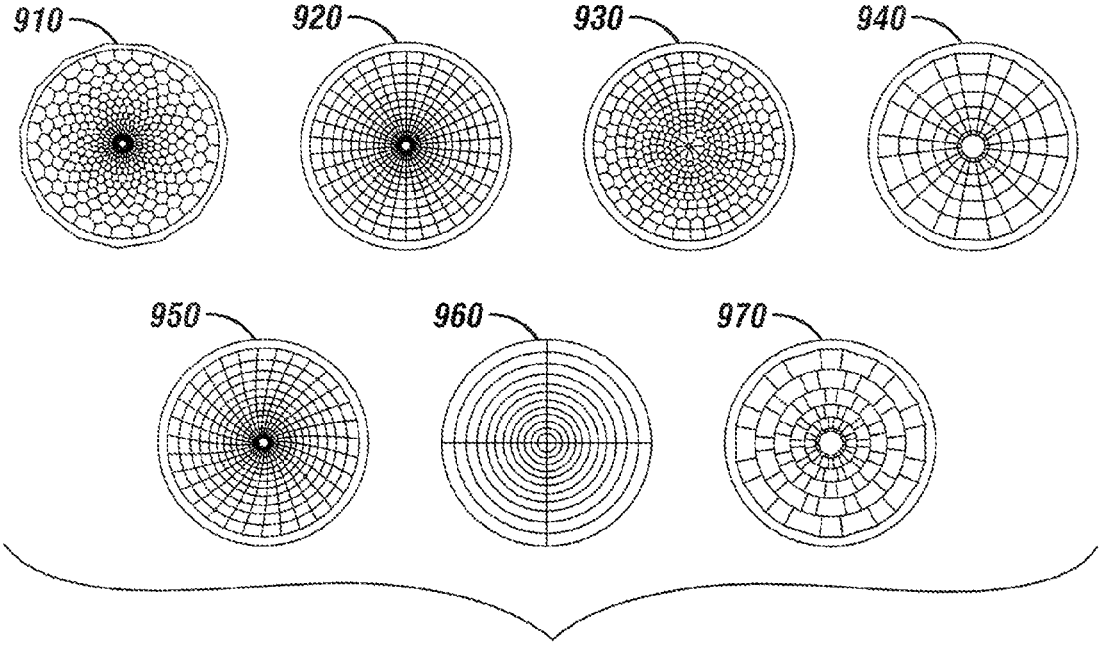
FIG. 9 illustrates exemplary reflective surface patterns that are positionable on a second portion of a reflector in accordance with an alternate exemplary embodiment of the present invention.

The reflector 310 is disposed around the HID lamp 100 and includes an internal surface 315 having a first portion 320 and a second portion 330. The first portion 320 extends from the proximal end 312 to an intermediate area 328. The second portion extends from the intermediate area 328 to the distal end 314. In one exemplary embodiment, the first portion 320 is a reflective smooth arcuate surface, while the second portion 330 is a reflective surface that includes multiple facets 332. In this exemplary embodiment, the second portion 330 is less reflective than the first portion 320 because the efficiency of the light emitted to an illuminated surface based upon light reflecting off of the second portion 330 is less than the efficiency of the light emitted to the illuminated surface based upon light reflecting off of the first portion 320. Although this exemplary embodiment depicts facets 332 on the inner surface of the second portion 330, other types of reflective surface patterns can be used in the alternative on the inner surface of the second portion 330 without departing from the scope and spirit of the exemplary embodiment. FIG. 9 illustrates just a few of the alternative types of reflective surface patterns available for use on the second portion 330 in accordance with an alternate exemplary embodiment. Referring to FIG. 9, the alternative reflective surface patterns include, but are not limited to, a hexagonal surface pattern 910, a rectangular surface pattern 920, an ideal facet-to-band surface pattern 930, a variable width facets-in-band surface pattern 940, a spiral surface pattern 950, a banded surface pattern 960, and a variable width alternating band surface pattern 970.

Referring back to FIG. 3, each facet 332 has a minimum width 333 located at or near the upper edge of the facet 332, which is adjacent the intermediate area 328. Additionally, each facet 332 has a maximum width 334 located at or near the lower edge of the facet 332, which is adjacent the distal end 314 of the reflector 310. According to some exemplary embodiments, the minimum width 333 is equal to the maximum width 334. In one exemplary embodiment, the relationship between the minimum width 333 of each facet 332, the maximum width 334 of each facet 332, and the arc tube diameter 142 (FIG. 1) can be shown as:

$$\tfrac{1}{2}*W_3 \le W_1 \le W_2 \le 2*W_3$$

where, $W_1$=the minimum width of each facet, $W_2$=the maximum width of each facet, and $W_3$=the diameter or maximum width of the arc tube.

In this exemplary embodiment, the facets 332 are flat-shaped, substantially flat, or planar, and smooth. In alternative embodiments, the facets 332 are arc-shaped, or curvilinear, having a smooth surface. Further, the curvilinear surface alternatively includes convex-shaped or concave-shaped surfaces. According to an exemplary embodiment, the first portion 320 and the second portion 330 are integrally formed. However, in alternate exemplary embodiments, the first portion 320 and the second portion 330 are formed separately and thereafter coupled to one another using methods known to people having ordinary skill in the art. The configuration for the exemplary reflector 310 provides a light emission efficiency of up to eighty percent. In other exemplary embodiments, the facets 332 include prismatic elements.

Figure 10A:
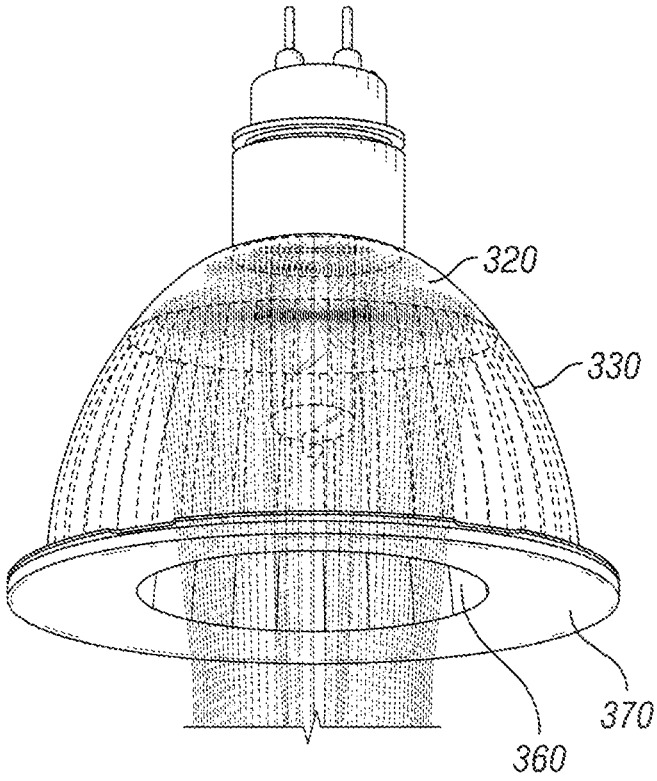
FIG. 10A is an illustration of the impact of light reflecting off the reflector's first portion on the lens' center portion in accordance with an alternate exemplary embodiment of the present invention.
Figure 10B:
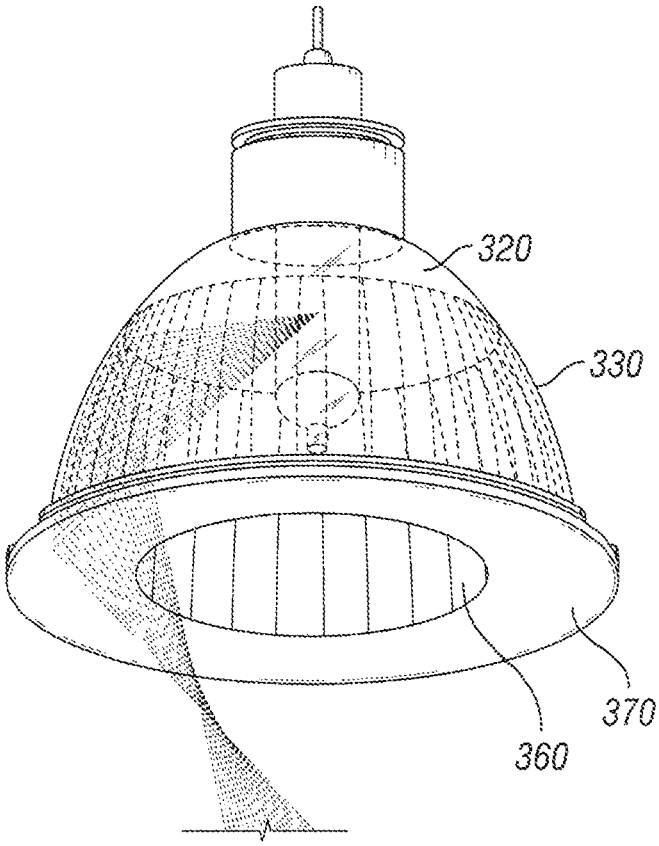
FIG. 10B is an illustration of the impact of light reflecting off the reflector's second portion on the lens' outer portion in accordance with an alternate exemplary embodiment of the present invention.

FIG. 10A is an illustration of the impact of light reflecting off the reflector's first portion 320 on the lens' center portion 360 in accordance with an alternate exemplary embodiment of the present invention. FIG. 10B is an illustration of the impact of light reflecting off the reflector's second portion 330 on the lens' outer portion 370 in accordance with an alternate exemplary embodiment of the present invention. Referring to FIGS. 3, 10A, and 10B, in exemplary operation, the first portion 320 of the reflector 310 affects the center portion of the light distribution area, as seen in FIG. 10A, which is typically not visibly affected by the gravity effect 210 or the wire shadow 220. Thus, the first portion 320 maximizes the light intensity distributed to the center portion of the light distribution area by minimizing the number of times the light is reflected prior to being emitted to the light distribution area. Thus, in this exemplary embodiment, the first portion 320 is smooth and highly reflective to maximize the light emission efficiency and the candle power at the center portion of the light distribution area. The second portion 330 affects the lighted area surrounding the center portion of light distribution area, as seen in FIG. 10B, which is typically more affected by the gravity effect 210 and the wire shadow 220. In this exemplary embodiment, the second portion 330 increases the mixing of the individual light beams, when compared to the mixing performed by the first portion 320, by reflecting the light more times and diffusing the light through the lens' outer portion 370 prior to being emitted in the lighted area surrounding the center portion of light distribution area. Thus, mixing the color of each beam on the second portion 330 and diffusing the emitted light through the lens' outer portion 370 reduces and/or eliminates the gravity effect, or yellowish color, and hides the wire shadow. Thus, in this exemplary embodiment, the second portion 330 is faceted. The exemplary facets 332 minimize the number of times the light ray is reflected, but still achieve reduction and/or elimination of the gravity effect 210 and the wire shadow 220.

When light from the HID lamp 100 travels to the distal end 314 of the reflector 310, the light is reflected at the edges of the distal end 314 and forms striations and yellowish color on the area to be illuminated. In the exemplary embodiment of FIG. 3, these striations and yellowish color caused by the light reflecting off the edges of the distal end 314 are eliminated by preventing that light from passing through the lens 350 including a diffuse outer portion 370 on the lens 350, further described below.

Referring back to FIG. 3, the distal end 314 of the reflector 310 includes one or more fasteners 316 for coupling the reflector 310 with the lens 350. According to this exemplary embodiment, the fasteners 316 are coupled to the flange 319 and include one or more tabs for coupling the reflector's distal end 314 to the lens 350. Additionally, the distal end 314 optionally includes one or more screw holes 318 for coupling of the lens 350 to the reflector's distal end 314. Alternatively, other types of fasteners known to people having ordinary skill in the art are used to couple the lens 350 to the reflector 310, either in addition to the described fasteners 316 and screw holes 318, or in lieu of them.

The exemplary lens 350 is coupled to and disposed below the reflector 310 Alternatively, the lens 350 is positioned adjacent to a reflector but not directly coupled thereto. The lens 350 includes a center portion 360 and an outer portion 370 surrounding the center portion 350. In one exemplary embodiment, the center portion 360 is clear and has a lens inner diameter 365. Furthermore, in this exemplary embodiment, the outer portion 370 is diffuse and extends from the lens inner diameter 365 to a lens outer diameter 375. Although the outer portion 370 is diffuse, the outer portion 370 allows some light to be transmitted therethrough to a desired area that is intended to be illuminated. The outer portion 370 eliminates the gravity effect 210, the wire shadow 220, and the striations and yellowish color caused by the light reflecting off the edges of the distal end 314 by mixing the light and blending the portion of light forming the yellowish color, the portion of the light forming the wire shadow, and the portion of the light forming the striations with the rest of the light prior to emitting the light onto the illuminated surface.

According to some exemplary embodiments, the outer portion 370 is frosted. A frosted outer portion is used to mean an outer portion of a lens which has been rendered translucent through a process which roughens or obscures the clear surface of the outer portion. In alternative exemplary embodiments, the outer portion 370 includes a micro-pattern. According to some of these alternative embodiments, the micro-patterns are formed by molding the lens 350 with the prismatic patterns or dimpled patterns also molded into the outer portion 370. According to an alternative exemplary embodiment, the micro-patterns are formed by molding the lens 350, covering the center portion 360 with a protective material, and sandblasting the lens 350, so that micro-patterns are formed onto the surface of the outer portion 370. In an exemplary embodiment, the micro-patterns are formed onto the surface of the outer portion that faces the illuminated area; however, alternate exemplary embodiments can have the micro-patterns formed onto the surface of the outer portion that faces away from the illuminated area without departing from the scope and spirit of the exemplary embodiment. Although examples of the outer portion 370 are described as being either frosted or micro-patterned, other types of diffuse surfaces that allow at least portions of the light to be transmitted therethrough are usable without departing from the scope and spirit of the exemplary embodiment. Although some exemplary methods have been described for diffusing the outer portion 370, other methods known to people having ordinary skill in the art can be used without departing from the scope and spirit of the exemplary embodiment.

Figure 4:
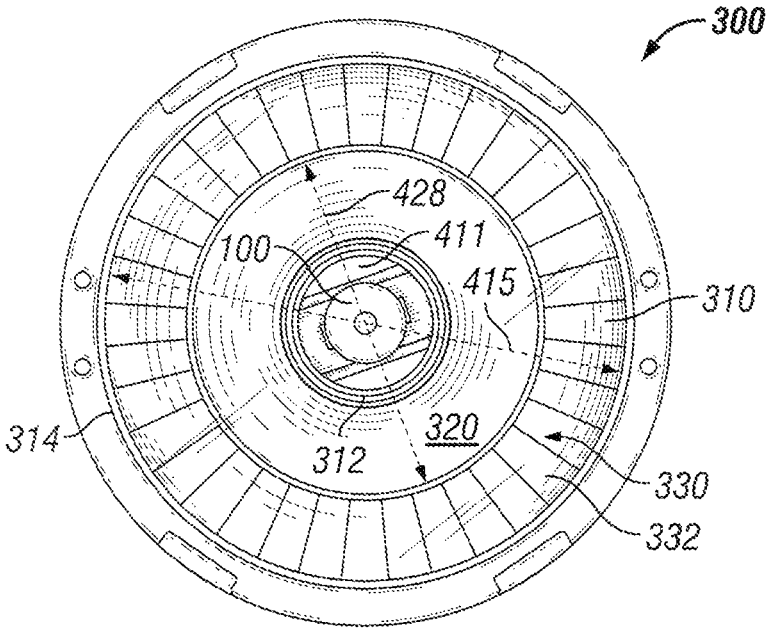
FIG. 4 is a bottom plan view of the HID luminaire of FIG. 3 in accordance with an exemplary embodiment of the present invention.
Figure 5:
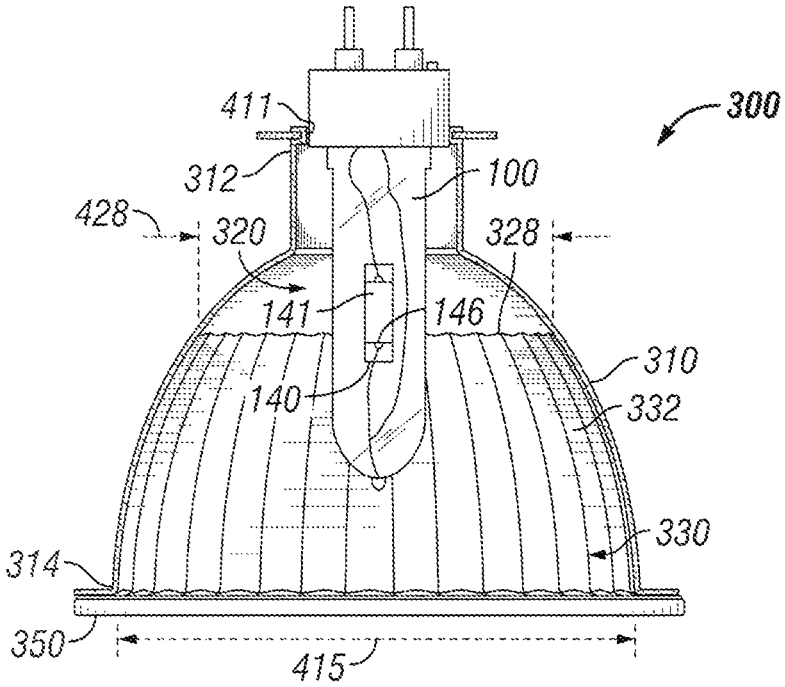
FIG. 5 is a cross-sectional view of the HID luminaire of FIG. 3 in accordance with an exemplary embodiment of the present invention.

FIG. 4 is a bottom plan view of the HID luminaire 300 of FIG. 3 in accordance with an exemplary embodiment of the present invention. FIG. 5 is a cross-sectional view of the HID luminaire 300 of FIG. 3 in accordance with an exemplary embodiment of the present invention. Referring to FIGS. 4 and 5, the lamp 100 is inserted into the reflector 310 through an opening 411 located at the proximal end 312 of the reflector 310. Although a plug-in type HID lamp 100 is described in this exemplary embodiment, other types of connections including, but not limited to, a screw-type connection can be used.

The reflector 310 includes the first portion 320, the second portion 330, and the intermediate area 328, which defines the transition point between the first portion 320 and the second portion 330. As previously mentioned, the first portion 320 extends from the proximal end 312 to the intermediate area 328, while the second portion 330 extends from the intermediate area 328 to the distal end 314. In certain exemplary embodiments, the intermediate area 328 is positioned at or substantially near the same elevational level as the arc tube cavity's bottom surface 146. However, in alternative exemplary embodiments, the intermediate area 328 is positioned at any elevational level ranging from the elevational level of the bottom of the arc tube 140 to about the elevational level of the top of the arc tube 140. The distal end 314 has a distal end diameter 415. The intermediate area 328 has an intermediate diameter 428, which, in this exemplary embodiment, is less than the distal end diameter 415.

As shown in the example of FIGS. 4 and 5, the first portion 320 is a highly reflective smooth surface and the second portion 330 includes the facets 332, described above. In one exemplary embodiment, the second portion 330 includes thirty-six facets. However, the number of facets 332 can range from four to one hundred facets depending upon the circumference of the reflector being used.

Figure 6:
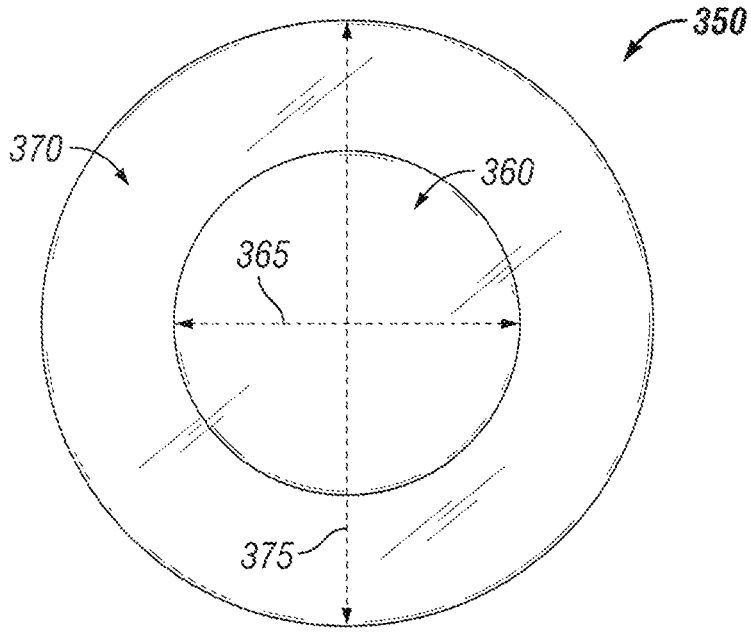
FIG. 6 is a bottom plan view of the lens for the HID luminaire of FIG. 3 in accordance with an exemplary embodiment of the present invention.

FIG. 6 is a bottom plan view of the lens 350 of FIG. 3 in accordance with an exemplary embodiment of the present invention. As discussed with regard to FIG. 3, the lens 350 includes a center portion 360 and an outer portion 370. In certain exemplary embodiments, the center portion 360 is clear and has a lens inner diameter 365. Furthermore, the outer portion 370 is diffuse and has a lens outer diameter 375. In one exemplary embodiment, the lens inner diameter 365 is equal to or substantially equal to the intermediate diameter 428, which is the diameter of the reflector 310 at the point where the first portion 320 transitions to the second portion 330. In this exemplary embodiment, the lens inner diameter 365 ranges from being about 12.5% greater than the intermediate diameter 428 to about 12.5% less than the intermediate diameter 428. Thus, the following equation is used to determine the length of the lens inner diameter 365:

$$D_2=(1\pm0.125)*D_1$$

where, $D_2$ is the distance of the lens inner diameter; and $D_1$ is the distance of the intermediate diameter.

Figure 7:
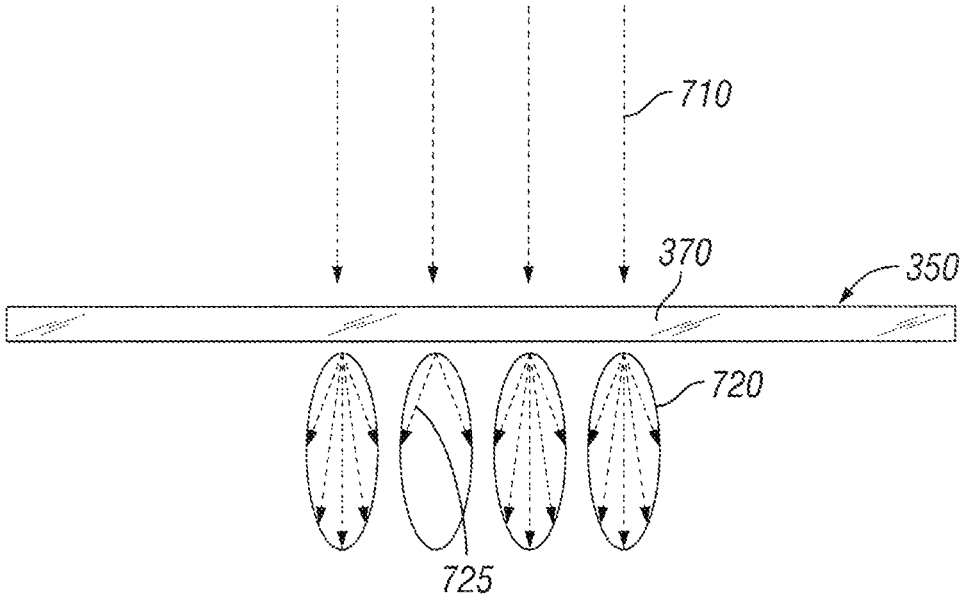
FIG. 7 is a schematic view of a lens for the HID luminaire of FIG. 3 illustrating the diffusivity of an outer portion of the lens in accordance with an exemplary embodiment of the present invention.

Although the exemplary outer portion 370 is diffuse, the outer portion 370 allows at least a portion of the light to be transmitted therethrough to an area to be illuminated. FIG. 7 is a schematic view of lens 350 illustrating the diffusivity of the outer portion 370 of the lens 350 in accordance with an exemplary embodiment. The outer portion 370 of the lens 350 has a diffusivity which allows a group of parallel incoming light rays 710 that is perpendicular to the outer portion 370 to travel through the outer portion 370 of the lens 350 and be emitted as outgoing light rays 720 having a beam spread angle 725 that, in one exemplary embodiment, is greater than 2.5 degrees. Alternatively, the beam spread angle has a range from 1.5 to 20 degrees.

Figure 8:
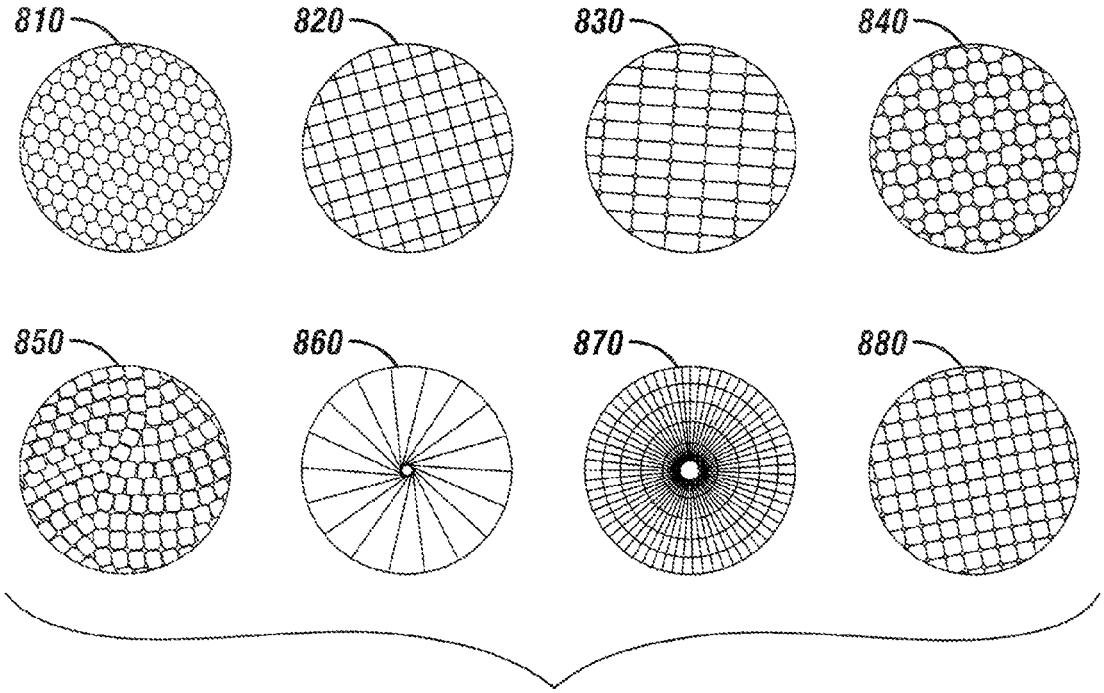
FIG. 8 presents exemplary micro-patterns positionable on the outer portion of the lens in accordance with alternative exemplary embodiments of the present invention.

FIG. 8 shows exemplary micro-patterns 810, 820, 830, 840, 850, 860, 870, and 880 that can be placed on the outer portion 370 of the lens 350 in accordance with alternative exemplary embodiments. In an exemplary embodiment, the micro-patterns are formed onto the surface of the outer portion that faces the illuminated area; however, alternate exemplary embodiments can have the micro-patterns formed onto the surface of the outer portion that faces away from the illuminated area without departing from the scope and spirit of the exemplary embodiment. These micro-patterns include, but are not limited to, a hexagonal micro-pattern 810, a square micro-pattern 820, a rectangular micro-pattern 830, a two-radii micro-pattern 840, a spiral micro-pattern 850, a toroidal micro-pattern 860, a polar grid micro-pattern 870, and a variable radii micro-pattern 880.

Although each exemplary embodiment has been described in detail, it is to be construed that any features and modifications that are applicable to one embodiment are also applicable to the other embodiments. Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A luminaire, comprising:
a light source; and
a reflector comprising:
a proximal end;
a distal end; and
an internal surface extending from the proximal end to the distal end, wherein the internal surface comprises:
an intermediate area;
a first portion extending from the proximal end to the intermediate area; and
a second portion extending from the intermediate area to the distal end, the second portion being less light reflective than the first portion,
wherein the first portion comprises a smooth arcuate surface.

2. The luminaire of claim 1, further comprising a lens disposed adjacent to the distal end of the reflector.

3. The luminaire of claim 2, wherein the lens comprises:
a lens first portion comprising a first diffusion rate; and
a lens second portion comprising a second diffusion rate different from the first diffusion rate.

4. The luminaire of claim 3, wherein the lens first portion comprises a center portion having a lens inner diameter and the lens second portion comprises an outer portion surrounding the center portion.

5. The luminaire of claim 4, wherein the first diffusion rate comprises a substantially clear lens and the second diffusion rate produces a plurality of outgoing light rays having a beam spread angle of greater or equal to 2.5 degrees when an incoming light ray enters the outer portion at a perpendicular angle.

6. The luminaire of claim 4, wherein the lens inner diameter is substantially equal to the diameter of the intermediate area.

7. The luminaire of claim 4, wherein the lens inner diameter ranges from about 87.5 percent to about 112.5 percent of the diameter of the intermediate area.

8. The luminaire of claim 4, wherein the center portion comprises a clear lens and the outer portion comprises a frosted lens.

9. The luminaire of claim 4, wherein the center portion comprises a clear lens and the outer portion of the lens comprises micro-patterns.

10. The luminaire of claim 1, wherein the second portion comprises a plurality of facets, each facet having an upper edge positioned adjacent the intermediate area and a lower edge positioned adjacent the distal end.

11. The luminaire of claim 10, wherein the light source comprises a high intensity discharge (HID) lamp, the HID lamp comprises an arc tube having an arc tube maximum width, wherein the width of the upper edge of the facet is greater than or equal to one-half of the arc tube maximum width, wherein the width of the lower edge of the facet is greater than or equal to the width of the upper edge of the facet, and wherein twice the arc tube maximum width is greater than or equal to the width of the lower edge of the facet.

12. The luminaire of claim 10, wherein each facet is substantially flat-shaped and comprises a smooth surface.

13. The luminaire of claim 10, wherein each facet is substantially flat-shaped and comprises at least one prismatic element on a surface of each facet.

14. The luminaire of claim 10, wherein each facet is arc-shaped and comprises a smooth surface.

15. The luminaire of claim 14, wherein each facet is concave.

16. The luminaire of claim 14, wherein each facet is convex.

17. The luminaire of claim 10, wherein each facet is arc-shaped and comprises at least one prismatic element on a surface of each facet.

18. The luminaire of claim 10, wherein the number of facets is between four and one hundred.

19. The luminaire of claim 1, wherein the second portion comprises a surface pattern selected form the group consisting of a hexagonal surface pattern, a rectangular surface pattern, an ideal facet-to-band surface pattern, a variable width facets-in-band surface pattern, a spiral surface pattern, a banded surface pattern, and a variable width alternating band surface pattern.

20. The luminaire of claim 1, wherein the lamp source comprises an HID lamp, the HID lamp comprises:
an arc tube comprising at least two electrodes and an arc tube cavity positioned between the two electrodes, the arc tube cavity comprising a top surface and a bottom surface,
wherein the intermediate area is positioned at an elevational level ranging from an elevational level of the bottom of the arc tube to an elevational level of the top of the arc tube when the HID lamp is operationally coupled to the luminaire.

21. The luminaire of claim 20, wherein the intermediate area is positioned substantially at the bottom surface of the arc tube cavity.

22. A luminaire, comprising:
a light source;
a reflector comprising:
a proximal end;
a distal end; and
an internal surface extending from the proximal end to the distal end, wherein the internal surface comprises:

an intermediate area;

a first portion extending from the proximal end to the intermediate area; and a second portion extending from the intermediate area to the distal end, the second portion being less light reflective than the first portion; and a lens disposed adjacent to the distal end of the reflector, wherein the lens comprises:

a first portion comprising a first diffusion rate and a center portion having a lens inner diameter; and a second portion comprising a second diffusion rate different from the first diffusion rate and an outer portion surrounding the center portion, wherein the center portion comprises a clear lens and the outer portion of the lens comprises micro-patterns.

23. The luminaire of claim 22, wherein the first diffusion rate comprises a substantially clear lens and the second diffusion rate produces a plurality of outgoing light rays having a beam spread angle of greater or equal to 2.5 degrees when an incoming light ray enters the outer portion at a perpendicular angle.

24. The luminaire of claim 22, wherein the lens inner diameter is substantially equal to the diameter of the intermediate area.

25. The luminaire of claim 22, wherein the lens inner diameter ranges from about 87.5 percent to about 112.5 percent of the diameter of the intermediate area.

26. The luminaire of claim 22, wherein the outer portion comprises a frosted lens.

27. The luminaire of claim 22, wherein the second portion comprises a plurality of facets, each facet having an upper edge positioned adjacent the intermediate area and a lower edge positioned adjacent the distal end.

28. The luminaire of claim 27, wherein each facet is substantially flat-shaped and comprises a smooth surface.

29. The luminaire of claim 27, wherein each facet is substantially flat-shaped and comprises at least one prismatic element on a surface of each facet.

30. The luminaire of claim 27, wherein each facet is arc-shaped and comprises a smooth surface.

31. The luminaire of claim 22, wherein the second portion comprises a surface pattern selected form the group consisting of a hexagonal surface pattern, a rectangular surface pattern, an ideal facet-to-band surface pattern, a variable width facets-in-band surface pattern, a spiral surface pattern, a banded surface pattern, and a variable width alternating band surface pattern.

32. A luminaire, comprising:

a light source;

a reflector comprising:

a proximal end;

a distal end; and an internal surface extending from the proximal end to the distal end, wherein the internal surface comprises:

an intermediate area;

a first portion extending from the proximal end to the intermediate area; and a second portion extending from the intermediate area to the distal end, the second portion being less light reflective than the first portion; and a lens disposed adjacent to the distal end of the reflector, wherein the lens comprises:

a first portion comprising a first diffusion rate and a center portion having a lens inner diameter; and a second portion comprising a second diffusion rate different from the first diffusion rate and an outer portion surrounding the center portion;

wherein the first diffusion rate comprises a substantially clear lens and the second diffusion rate produces a plurality of outgoing light rays having a beam spread angle of greater or equal to 2.5 degrees when an incoming light ray enters the outer portion at a perpendicular angle.

33. A luminaire, comprising:

a light source; and a reflector comprising:

a proximal end;

a distal end; and an internal surface extending from the proximal end to the distal end, wherein the internal surface comprises:

an intermediate area;

a first portion extending from the proximal end to the intermediate area; and a second portion extending from the intermediate area to the distal end, the second portion being less light reflective than the first portion, wherein the second portion comprises a plurality of facets, each facet having an upper edge positioned adjacent the intermediate area and a lower edge positioned adjacent the distal end, and wherein the light source comprises a high intensity discharge (HID) lamp, the HID lamp comprises an arc tube having an arc tube maximum width, wherein the width of the upper edge of the facet is greater than or equal to one-half of the arc tube maximum width, wherein the width of the lower edge of the facet is greater than or equal to the width of the upper edge of the facet, and wherein twice the arc tube maximum width is greater than or equal to the width of the lower edge of the facet.

* * * * *